United States Patent [19]

Block et al.

[11] 4,130,059

[45] Dec. 19, 1978

[54] DECOY MEANS AND METHOD THEREFOR

[75] Inventors: Kenneth A. Block, Claremont; Leon J. Lader, Los Angeles, both of Calif.

[73] Assignee: General Dynamics Corporation, Pomona, Calif.

[21] Appl. No.: 570,140

[22] Filed: Aug. 2, 1966

[51] Int. Cl.[2] ..... F42B 13/42

[52] U.S. Cl. ..... 102/34.4; 102/89 C; 102/89 D; 343/18 E

[58] Field of Search ..... 102/49.4, 34.4, 37.6, 102/89; 250/33.65; 325/375–382; 343/18 B, 18 E; 206/65

[56] References Cited

U.S. PATENT DOCUMENTS

| | | | |
|---|---|---|---|
| 2,492,358 | 12/1949 | Clark | 250/33.65 |
| 3,049,080 | 8/1962 | Schermuly | 102/37.6 |
| 3,095,814 | 7/1963 | Jansen et al. | 102/49 |
| 3,098,973 | 7/1963 | Wickersham, Jr. et al. | 325/375 |
| 3,221,875 | 12/1965 | Paquette | 206/65 |

OTHER PUBLICATIONS

*History of Chaff Development* by George W. Schivley; WADC Tech. 59-6; Astia Document No. AD 208853; Wright Air Development Center, Jan. 1959, pp. 1–8.

*Primary Examiner*—Verlin R. Pendegrass
*Attorney, Agent, or Firm*—Lafayette E. Carnahan; Edward B. Johnson

[57] ABSTRACT

A harmonic converting or generating material, particularly adapted for use as chaff in decoy rounds, and a method of fabricating the same. The material is formed from metallic foil to have the characteristics of a dipole and which by the addition to the midpoint thereof of semiconductor or other polarizable material has the capability of reradiating incident frequencies along with radiating harmonics thereof or undesirable noise. Thus, the passive material, when activated by an active source, such as a radar unit, serves to convert or generate spurious frequencies, harmonics and noise, in addition to reradiating the fundamental frequency of the active energy source, thus giving the illusion of a plurality of independent energy sources.

18 Claims, 6 Drawing Figures

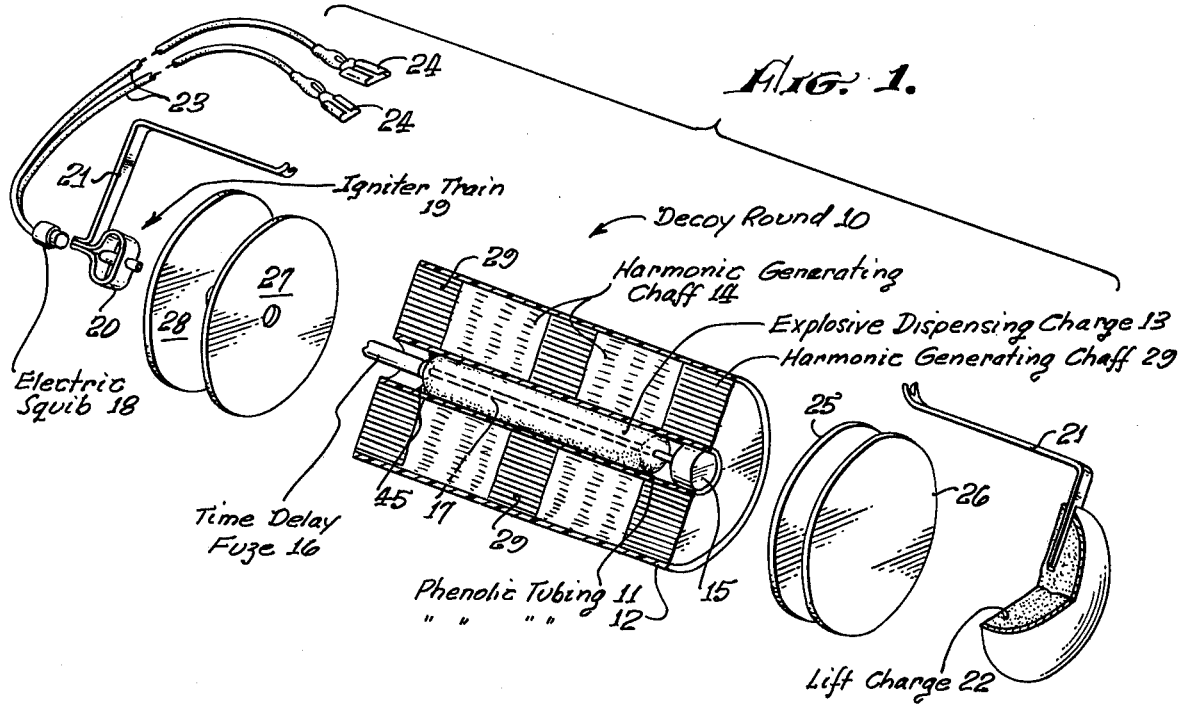
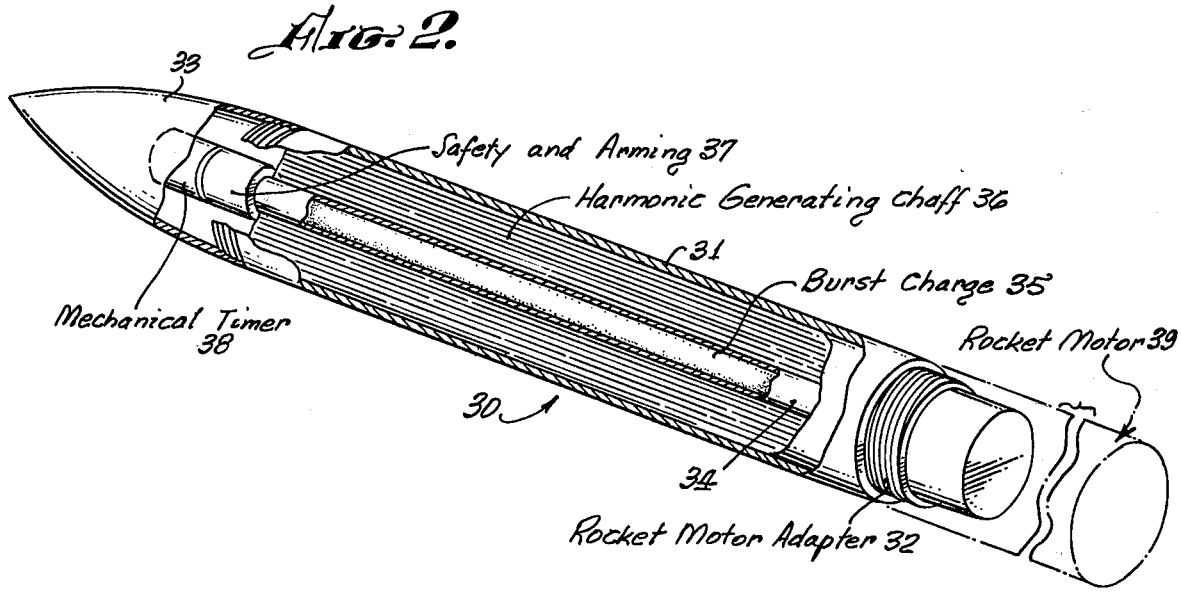
INVENTORS.
KENNETH A. BLOCK,
LEON J. LADER,
By L. E. Carnahan
AGENT.

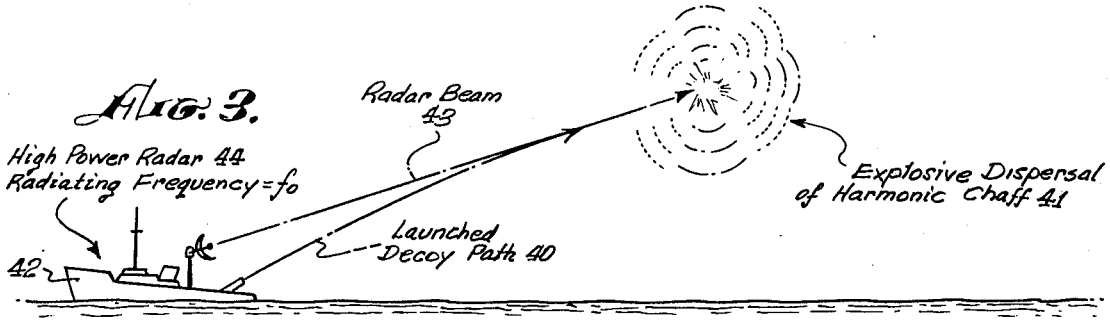
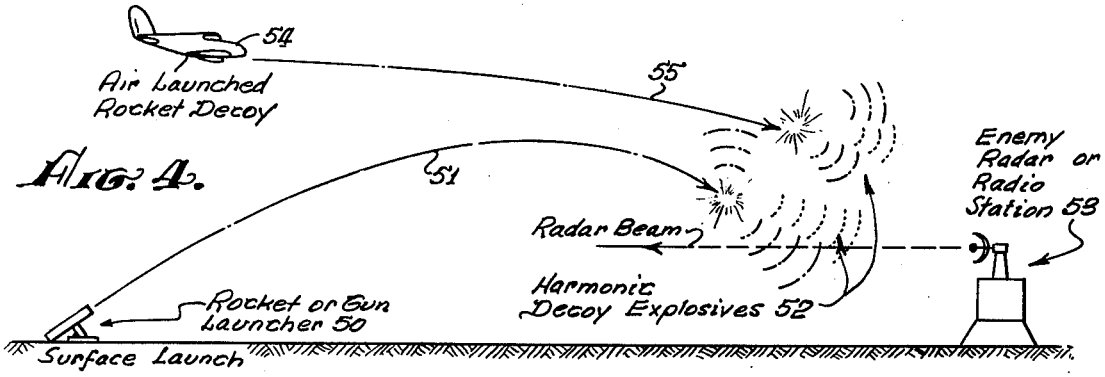
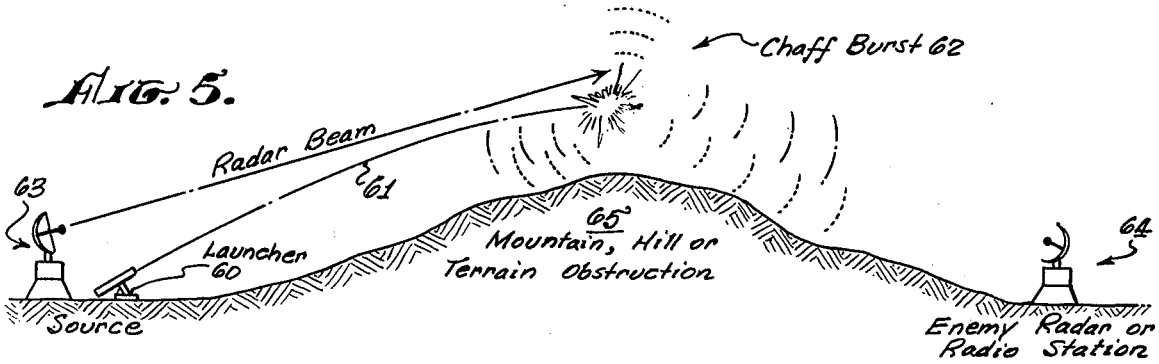
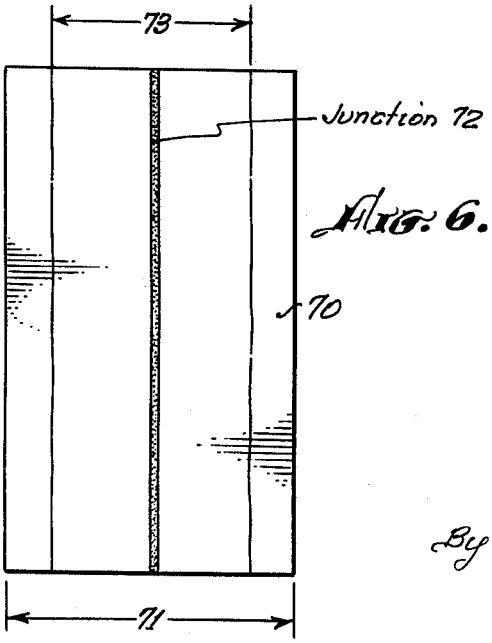
FIG. 6.
INVENTORS.
KENNETH A. BLOCK,
LEON J. LADER,
By L. E. Carnahan
AGENT

DECOY MEANS AND METHOD THEREFOR

This invention relates to means for providing a protective cover against homing and/or fire control devices operating upon microwave energy or for confusing search and tracking devices, particularly to decoy rounds, and more particularly to harmonic generating chaff for decoy rounds and method for fabricating same.

Various types of decoy systems and rounds are known in the art. Primarily, the prior art decoy rounds are based on the microwave reflected energy concept wherein energy from an active source, such as a radar unit, is reflected by the decoy material, the frequency or frequencies reradiated being dependent on that of the active source.

The present invention provides decoy material in which a passive source is produced which is physically displaced from the active source, but which radiates frequencies which are not transmitted by the active source in addition to reradiating the frequency of the active source, thereby creating the illusion of a plurality of independent sources. By radiating spurious frequencies, harmonics and noise, in addition to reradiating the fundamental, this material is effective in decoying missiles, inactivating fuzes, jamming radars and communication receivers which are susceptible, without revealing the nature of vital defended units. In addition this material may be used in automatically repeating communications on several frequencies, which may be received nearby or over the horizon or terrain obstructions as a result of the height which the material has been dispersed.

Therefore, it is an object of this invention to provide means of decoying and jamming frequency selective receivers, confusing radars, and masking targets.

A further object of the invention is to provide harmonic generating material and method of fabricating same.

Another object of the invention is to provide a decoy round which utilizes material capable of reradiating at least one frequency from an active source while radiating spurious frequencies, harmonics and noise.

Other objects of the invention, not specifically set forth above will become readily apparent from the following description and accompanying drawings wherein:

FIG. 1 is a partially exploded, partial cross-sectional view of an embodiment of a decoy round utilizing the inventive material;

FIG. 2 is a view of another embodiment of a decoy round utilizing the inventive material, with portions being cut away to illustrate the internal components thereof;

FIGS. 3–5 are views illustrating applications of decoy rounds incorporating the inventive material; and FIG. 6 is a view partially illustrating the method for fabricating the harmonic generating material.

Broadly, the invention is directed to harmonic generating material, particularly adapted for use as chaff in decoy rounds, and to a method of fabricating the same. The material is formed from metallic foil to have the characteristics of a dipole and which by the addition to the midpoint thereof of semiconductor or other polarizable material, serving in the nature of a rectifying or varactor junction, has the capability of reradiating incident frequencies along with generated harmonics thereof. The dipole units are manufactured by a method wherein a sheet of foil has been applied thereto a strip running down the middle of semiconductor or other material and then the sheet is sliced transversely into strips so that the semiconductor material will be at the center of each strip to form a loaded dipole.

The embodiment of the decoy round illustrated in FIG. 1 is, for example, adapted to be launched from the mechanism described and claimed in copending U.S. patent application Ser. No. 421,751, assigned to the same assignee. The round 10 illustrated in FIG. 1 generally comprises phenolic tubing 11 and 12, tubing 11 being positioned within tubing 12 and designed to retain an explosive dispersing or burst charge 13 which disperses the inventive harmonic generating chaff 14, made in accordance with the method described hereinafter, contained intermediate tubing 11 and 12. A plug 15 is positioned within one end of the tube 11, and in abutment with burst charge 13. Extending through a central aperture in the opposite end of tube 11 is a time delay fuse 16, in this embodiment of a 5 second delay type, which extends into the burst charge 13 and is operatively associated with a "black match" indicated in phantom at 17 which extends through the length of the charge 13. The "black match" may be constructed of a 12-ply cotton twine coated with black powder. The "black match" 17 assures rapid "line" detonation. Connecting time delay fuse 16 to an electric squib 18 is an igniter train 19 which includes a section 20 connected to fuze 16 and a section 21 connected to a lift charge 22. Squib 18 is connected with lead squib wires 23 which are connected via spring clips 24 to the launcher mechanism (not shown) but which may be of the type set forth in the above cited copending application. The lift charge 22 is separated from the plug 15 by a pair of discs 25 and 26 and paper wrapping material (not shown). Another pair of discs 27 and 28 and associated wrapping paper (not shown) separate the ignitor train 19 from the opposite end of tube 11. The embodiment of the round 10 shown in FIG. 1 consists of two sections of chaff 14 of harmonic generating S-band and C-band. The sections of chaff 14 are separated from each other and from the end covers by sections of harmonic generating X-band chaff indicated at 29.

As pointed out above the harmonic generating chaff 14 and 29 provides the advantage that a passive source is produced, physically displaced from the active source, such as a radar unit (see FIGS. 3–5), which radiates frequencies which are not transmitted by the active source, thereby creating the illusion of a plurality of independent sources, in addition to reradiating the same frequency as the active source. The chaff 14 and 29 is formed from metallic foil to have the characteristics of a dipole and which by the addition to the midpoint thereof of semiconductor or other polarizable material (see FIG. 6), serving in the nature of a rectifying or varactor junction, has the capability of reradiating incident frequencies along with generated harmonics thereof.

While the FIG. 1 embodiment has been described as having a specific chaff arrangement, the various sections of chaff may be interchanged or the entire round may be composed, for example, entirely of either C-band, S-band, X-band, or other frequency band length chaff, if desired.

The round 10 illustrated in FIG. 1 may be, for example, about 2¾ inches in diameter and about 8 inches long overall. The round may be protected by a plastic bag during shipping, storing, and firing. For firing, the top of the bag may be slit and the two lead or squib wires 23 removed and uncoiled, then the package; namely, round and bag is inserted into the launcher mechanism. Upon actuation of the launcher power source, the electric squib 18 in the round 10 ignites simultaneously both the lift charge 22 and the time fuze 16 via the ignitor train 19. The lift charge 22 propels the round 10 from the launcher in a ballistic trajectory. The time fuze 16 ignites a burst charge 13 which disperses the payload (chaff sections 14 and 44) at the optimum point for the type of round being used.

While the embodiment of the decoy round 10 illustrated in FIG. 1 is adapted for relatively short range applications the FIG. 2 round is adapted for launch from either land, water craft, or aircraft by a weapon such as the conventional 2.75 rocket, thus providing a longer range of applications of several miles. Referring now to FIG. 2, the round indicated at 30 generally comprises a casing or phenolic tube 31 having a rocket motor adapter 32 operatively connected to one end and a nose cone 33 operatively connected at the opposite end. A central hollow tube 34 extends throughout the length of casing 31 and contains a burst charge 35 similar to that previously described. Contained intermediate the casing 31 and central tube 34 is the harmonic generating chaff 36. Operatively connected to the burst charge 35 and positioned within nose cone 33 is a safety and arming device 37 and a mechanical timer 38. Since this invention is not directed to either of the devices 37 and 38, a detailed description is deemed unnecessary except to state that they function to activate the burst charge 33 and thus disperse the chaff load 36. As in the FIG. 1 embodiment, the burst charge 35 provides a "line" explosion as opposed to a "point" explosion. Rocket motor adapter 32 is operatively connected to a rocket motor 39 indicated in phantom lines which provides the propulsion for the round 30.

The chaff loads of either the FIG. 1 or the FIG. 2 embodiments produces a passive source, physically displaced from an active source, which radiates frequencies which are not transmitted by the active source, thereby creating the illusion of two or more independent sources. The prior known decoy devices reradiate only the same frequency as the active source. Thus the chaff of this invention radiates spurious frequencies, harmonics and noise, in addition to reradiating the fundamental frequency. These spurious frequencies may be used to decoy missiles, inactivate fuzes, jam radars and communication receivers which are susceptible without revealing the nature of the vital defended unit. This type of chaff of lower fundamental frequencies may be employed to jam harmonically related receivers over many octaves. The chaff may be localized in the vicinity of an attack or enemy element so that his radiation jams his own electronics. The presence of spurious frequencies could cause the enemy to reduce his jammer power density in an effort to blanket a wider spectrum. Also, the harmonic generating chaff may be utilized in automatically repeating communications on several frequencies, which may be received nearby or over the horizon or terrain obstructions as a result of the altitude of the chaff.

The inventive chaff, as described above and illustrated hereinafter with respect to FIGS. 3–5, functions, as known in the semiconductor art, due to the relatively quiescent electrons in the semiconductor material being activated by the impinging electromagnetic field coming from the active source or radar. Thus, the normal or relatively quiescent condition of the electrons is disturbed by the field and the incoming energy is partially converted into harmonics, spurious frequencies or noise, thereby appearing to generate these radiations, along with reradiating the fundamental frequency or frequencies of the active sources.

FIG. 3 illustrates an example of the utility of the inventive harmonic generating chaff. As shown, a decoy round of, for example, the FIG. 1 type, is launched along the flight path 40 by launch mechanism of, for example, the type described in the above referenced application, and exploded as a protective cover 41 to a ship 42. The radar beam 43 from a high power radar 44 (active source) which radiates a frequency of $f_o$ strikes the dipoles of the harmonic chaff 41. The dipoles reradiate the original frequency $f_o$. In addition, the dipoles radiate frequencies of 2 $f_o$, indicated by the dotted curved lines, and 3 $f_o$, indicated by the curved dot-dash lines, etc., plus noise (random) components and the cross products of the various frequencies. The various frequencies are radiated as an omnidirectional source. Interference results from the random unwanted frequencies as they may be received by radar or radio receivers. The FIG. 3 illustration shows how to create a false target to a radar or homing system attacking the ship 42.

FIG. 4 illustrates an example of the utility of the inventive harmonic generating chaff when used in a long range round of the type shown in FIG. 2. As shown, a decoy rocket type round is launched from a surface mounted launcher 50 along a flight path 51 and exploded at 52 in enemy territory adjacent an active source such as a radar or radio station 53 or as an air launch from aircraft 54 along path 55 and exploded in the area of station 53. The r-f interference created by the decoy will disrupt the operation of the radar or radio set at station 53. The means of interference would be by the same means as described with respect to FIG. 3, i.e., radiation from the enemy set 53 would strike the chaff dipoles and develop unwanted harmonics and noise.

FIG. 5 illustrates an application of a decoy round containing the inventive harmonic generating being effectively utilized for the propagation of an interference that is not line of sight due to a mountain, hill or other terrain obstruction. As shown, this is accomplished by launching a decoy round from a surface mounted launcher 60 along a flight path 61 and exploded at 62 so that it is in line of sight between two radar stations or active sources 63 and 64 on opposite sides of the terrain obstruction 65 at the point of burst. By radiating high power energy from the friendly source 63 to the chaff cloud 62 whereby reradiation will then occur and will be received by the enemy station 64 located behind the terrain obstruction 65. The interference affects the station 64 in the same manner as described above with respect to FIGS. 3 and 4.

The harmonic generating material of the invention may be produced by the novel fabrication method set forth hereinbelow. This is accomplished by producing dipoles loaded with a non-linear junction with no increase in bulk and negligible increase in cost over linear dipoles. Using this novel method of fabrication, dipoles having non-linear junctions can be machine produced in quantity as opposed to the method of fabricating individual junctions and attaching leads. Thus, chaff made in accordance with this novel method air floats like linear chaff and thus permits the deployment of a non-linear chaff cloud as a missile decoy, radar or radio confuser, and communications harmonic repeater.

The manufacturing steps set forth below and partially shown in FIG. 6 illustrate the novel method of fabricating the harmonic generating material.

1. Preparation of Basic Stock:
   (a) Two conducting bars (copper, aluminum, etc.) are formed with nominal dimensions, for example, $\frac{1}{4} \times 1 \times 50$ cms. The $\frac{1}{4}$ cm. faces are machined flat (and cleaned) so that they may be butted with negligible air gap.
   (b) A layer of semi-conductor material, such as silicon, or other polarizable material, is deposited on one of these faces by vacuum deposition or other suitable technique.
   (c) The two bars are then welded along the $\frac{1}{4}$ cm. faces into a composite bar in a vacuum furnace or other non-contaminating welding process. The welds need only be strong enough to withstand the manufacturing processing, since there is negligible tensile force in use.
2. Rolling the Foil:
   (a) The composite bar is then rolled out into a long strip of foil between rollers and cut into strips several feet long. The foil may, for example, be rolled to a thickness of 0.03 to 0.05 millimeters. In this portion of the process the width of the foil will increase.
   (b) The strips are stacked and trimmed to the required dipole resonant length. FIG. 6 shows a strip 70 of aluminum foil which has been rolled to the desired thickness and width indicated by the double arrow 71, the strip 70 having the semiconductor material 72 extending down the center thereof. The foil strip 70 is trimmed as indicated by the double arrow 73 to the required dipole resonant length.
   (c) The individual strips 70 are then inspected, tested, and a junction formed by the application of a current accross the semi-conductor or junction 72.
3. Cutting the Dipoles:
   (a) A stack of foil strips 70 is then placed in a slicing machine and advanced in steps of about 0.1 to 0.15 millimeters per slice, producing many of dipoles per slice, the dipoles having a non-linear junction 72 therein.
   (b) These dipoles are collected for later use.

It has thus been shown that this invention provides harmonic generating material, and fabrication method therefor, which effectively functions for decoying and jamming frequency selective receivers, confusing radars, masking targets, and other uses which result from the radiation of frequencies, harmonics and noise, not transmitted by an active source.

By way of illustration, the electromagnetic effects of illuminating the non-linear chaff cloud can be evaluated with reasonable accuracy. If the effective area of a dipole, $A_e = 1.64\lambda^2/4\pi$ is equal to the physical area of a dipole, the area illumination flux can be intercepted by 70 S-band dipoles per square foot. At a range of 500 feet from a 1.3° radar beam, the area is about 100 square feet or 7000 dipoles to the half power points, approximately a total of $10^4$ dipoles to produce a nearly continuous sheet normal to the beam axis. If a transmitter is used having an average power of 10 Kw driving a 50% efficient antenna whose beam is intercepted by $10^4$ dipoles, then the power in a matched load of each dipole will be about 0.25 watt, which is adequate to generate harmonics efficiently. For C-band, X-band, or other frequencies, different numbers of dipoles would be required in the above example.

While the application of the novel method described above has been directed toward the fabrication of decoy chaff, it also has utility in the manufacture of solid state components, purely resistive and capacitative components, and thermocouples or thermoelectric junctions providing the proper types of material known in the art are used.

Although particular embodiments have been utilized to illustrate the application of the inventive harmonic generating material and specific materials and sequential procedures have been described, the material, modifications and changes will become apparent to those skilled in the art, and it is intended to cover in the appended claims all such modifications and changes as come within the true spirit and scope of the invention.

What we claim is:

1. A decoy round comprising: at least one load of passive energy converting material, means for propelling said load, a burst charge for shattering said load, and means for igniting said burst charge, said passive energy converting material including at least some material composed of a multiplicity of dipoles having passive non-linear junctions therein and capable of reradiating frequencies transmitted by an associated active energy source while radiating frequencies which are not transmitted by an associated active energy source, thus giving the illusion of a plurality of independent energy sources.

2. The decoy round defining in claim 1, wherein said dipoles are constructed of aluminum and said junction is of polarized material.

3. The decoy round defined in claim 2, wherein said polarized material is a semi-conductor.

4. The decoy round defined in claim 3, wherein said semi-conductor is composed of silicon.

5. The decoy round defined in claim 1, wherein said burst charge is constructed so as to cause a line type explosion.

6. Passive energy converting material composed of chaff capable of reradiating microwave energy and capable of radiating microwave energy, said chaff including a multiplicity of dipoles, said dipoles having lengths such as to resonate at desired frequencies and being provided with passive non-linear junctions therein, said reradiated microwave energy is reradiated at a fundamental frequency, and said radiated microwave energy comprising at least one harmonic of said fundamental frequency.

7. The passive energy converting material defined in claim 6, wherein said dipoles are composed of aluminum, and said passive non-linear junctions are constructed of polarized material.

8. The energy converting material defined in claim 7, wherein said polarized material is a semi-conductor.

9. The energy converting material defined in claim 8, wherein said semi-conductor is composed of silicon.

10. The energy converting material defined in claim 9, wherein said non-linear junctions are constructed of a semi-conductor material.

11. A method of fabricating energy converting material capable of reradiating microwave energy and capable of radiating microwave energy comprising the steps of: depositing a layer of polarizable material on one face of a pair of bars constructed of conducting material; welding the conducting bars together such that the polarizable material is located intermediate the bars;

rolling the composite bar into a long strip of foil; cutting the long strips into desired shorter strips of desired length; stacking the shorter strips; trimming the stacked strips to the desired dipole resonant length; forming a non-linear junction on the strips by the application of a suitable electric current across the polarizable material; and slicing the stacked and trimmed strips to a desired thickness and in a direction which crosses the junction, thus forming a multiplicity of dipoles having non-linear junctions therein.

12. The method defined in claim 11, wherein the polarizable material is deposited on the conducting bar by vacuum deposition techniques.

13. The method defined in claim 11, wherein the conducting bars have dimensions of about $\frac{1}{4} \times 1 \times 50$ cm, and the polarizable material is deposited on the $\frac{1}{4}$ cm face of the bar.

14. The method defined in claim 11, additionally including the step of machining at least the adjacent faces of the conducting bars so that they may be butted with negligible air gap therebetween.

15. The method defined in claim 11, wherein the welding of the conducting bars is accomplished by a non-contaminating welding process.

16. The method defined in claim 11, wherein the composite bars are rolled into foil having a thickness in the range between about 0.03 to about 0.05 millimeters.

17. The method defined in claim 11, wherein the stacked strips are sliced to a thickness of about 0.1 to about 0.15 millimeters.

18. The method defined in claim 11, additionally including the step of packaging the multiplicity of thus formed dipoles in desired quantities.

* * * * *